US005730633A

United States Patent [19]

Henmi et al.

[11] Patent Number: 5,730,633

[45] Date of Patent: Mar. 24, 1998

[54] IMPELLER SHAFT SEAL AND LUBRICATOR ARRANGEMENT

[75] Inventors: Yasuhiko Henmi; Chihiro Matsumoto, both of Hamamatsu, Japan

[73] Assignee: Sanshin Kogyo Kabushiki Kaisha, Hamamatsu, Japan

[21] Appl. No.: 575,499

[22] Filed: Dec. 20, 1995

[30] Foreign Application Priority Data

Dec. 21, 1994 [JP] Japan ..... 6-317981

[51] Int. Cl.[6] ..... B63H 23/36

[52] U.S. Cl. ..... 440/112

[58] Field of Search ..... 440/38, 111, 112; 277/58, 59

[56] References Cited

U.S. PATENT DOCUMENTS 5,152,704 10/1992 Carlson ..... 440/112
5,372,526 12/1994 Ozawa et al. ..... 440/38

FOREIGN PATENT DOCUMENTS 2205365 12/1988 United Kingdom ..... 440/112

*Primary Examiner*—Stephen Avila
*Attorney, Agent, or Firm*—Knobbe, Martens, Olson & Bear LLP

[57] ABSTRACT

A seal arrangement for a marine propulsion drive that insures good sealing and adequate lubrication.

3 Claims, 5 Drawing Sheets

IMPELLER SHAFT SEAL AND LUBRICATOR ARRANGEMENT

BACKGROUND OF THE INVENTION

This invention relates to an arrangement for journaling the drive shaft of a marine propulsion unit and for lubricating the journaling bearing.

In many forms of marine propulsion units the engine for propelling the watercraft is contained within an engine compartment of the watercraft and drives a propulsion device through a shaft arrangement that extends through a bulkhead of the watercraft which bulkhead normally is formed at one end of the engine compartment. Frequently, it is the practice to employ a spline connection in this area to accommodate some axial misalignment. It is desirable if the supporting bearing is lubricated and various arrangements have been proposed for delivering lubricant to the bearing.

A typical type of support includes an anti-friction bearing that has an inner race that is supportingly engaged with a shaft that extends through an outer supporting hub. The outer race for the bearing is supported in this supporting hub and the supporting hub is affixed in some manner to the bulkhead. Obviously, seals are provided outboard of the bearing and the lubricant is delivered to the area between these seals. Such an arrangement is shown in the U.S. Pat. No. 5,372,526 issued Dec. 13, 1994 and assigned to the assignee hereof, which patent is entitled "Drive Bearing Lubricating Device For Water Injection Propulsion Vessel."

Although this type of system is extremely effective, there is some risk that the seal may move or be displaced in some manner axially relative to the lubricant entry port and block it.

It is, therefore, a principal object of this invention to provide an improved bearing and lubricating arrangement of this same general type.

It is a further object of this invention to provide an improved shaft and bearing support for a marine propulsion unit wherein the bearing can be lubricated and, nevertheless, effectively sealed.

SUMMARY OF THE INVENTION

This invention is adapted to be embodied in a bearing arrangement for supporting an interconnection between an engine output shaft and the propulsion unit input shaft in a marine propulsion unit. These shafts are joined adjacent a bulkhead and through which at least one of the shafts pass. A support hub is affixed to this bulkhead and encircles the shaft arrangement. An outer race of a anti-friction bearing is affixed axially within this support hub in a location between the outer ends of the support hub. A pair of seals are held in the outer hub on opposite sides of the bearing and sealingly engage the shaft passing through the inner race of the bearing. A spacer member is provided between the bearing and at least one of the seals for fixing the axial distance therebetween. A lubricant supply passage extends through the outer hub and enters into the space where the spacer is positioned.

DETAILED DESCRIPTION OF THE PREFERRED EMBODIMENTS OF THE INVENTION

Figure 1:
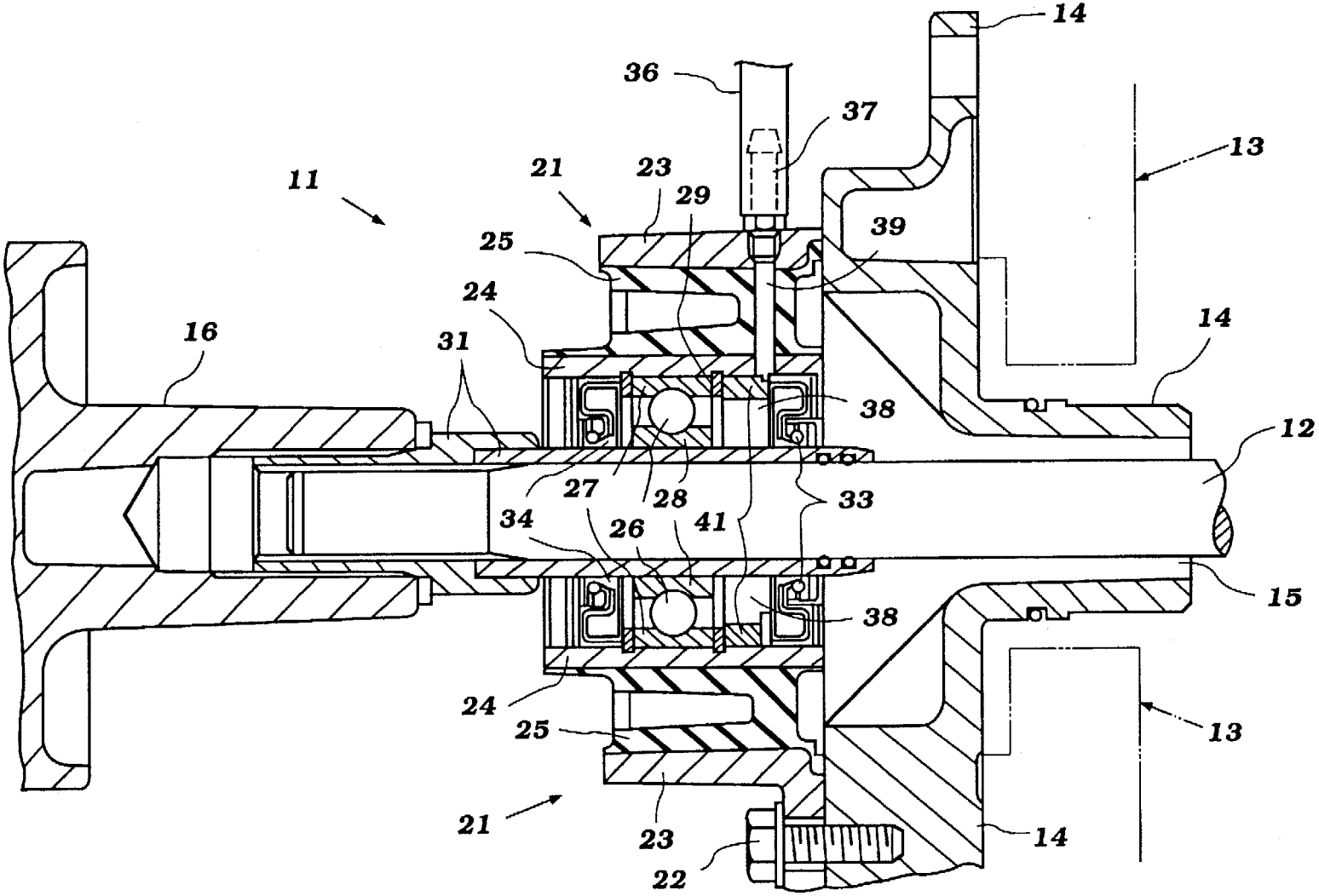
FIG. 1 is a cross-sectional view of a bearing assembly constructed in accordance with a first embodiment of the invention.
Figure 2:
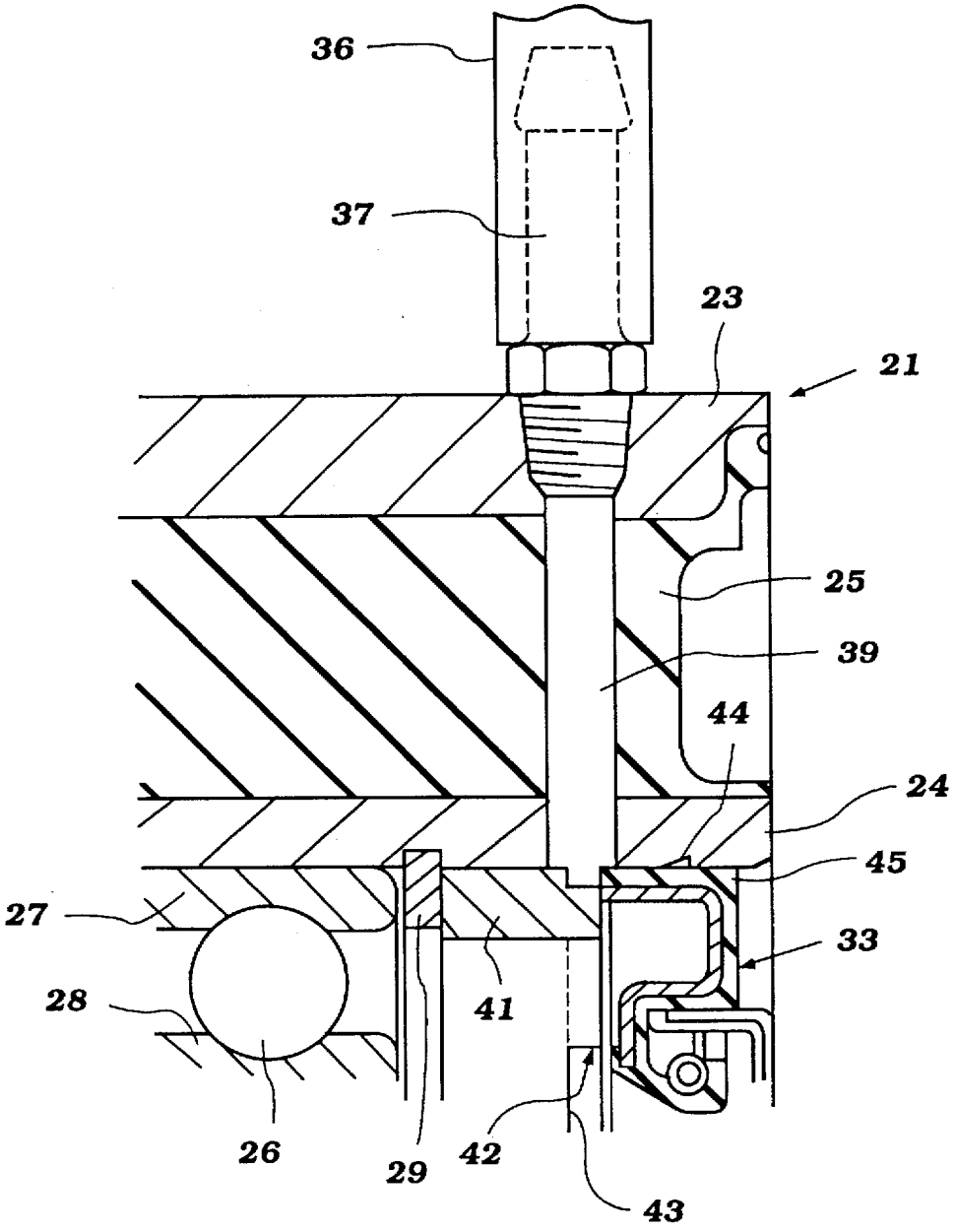
FIG. 2 is an enlarged cross-sectional view of the bearing assembly.

Referring to the drawings and initially to FIGS. 1 and 2, a bearing assembly is indicated generally by the reference numeral 11 and serves to journal a drive shaft 12 through a bulkhead 13 of a personal watercraft to transmit the drive from an engine output shaft to the impeller (not shown) of a jet propulsion unit. A tubular hub 14 is rigidly affixed to the bulkhead 13 and encircles the drive shaft 12 within a cavity 15 that is disposed between the inner surface of the tubular hub 14 and the drive shaft 12.

The bulkhead 13 comprises a portion of the hull of the watercraft and separates an engine compartment located forward of the bulkhead 13 and in which is positioned the bearing assembly 11 from a tunnel-like portion of the lower hull. The aforedescribed a jet propulsion unit is disposed in this tunnel, as is well known in this art. The jet propulsion unit is powered by an internal combustion engine (not shown) located in the engine compartment which has an output shaft 16 that is rigidly affixed to the drive shaft 12 forward of the bearing 11 by means of a splined connecting shaft 31.

The construction of the bearing assembly 11 will now be discussed in detail. An outer supporting hub assembly 21 is affixed by means of bolts 22 to the forward face of the tubular hub 14 and is composed of an outer housing 23, an inner housing 24 and an intermediate elastic sleeve 25 that is fixed between the outer and inner housings 23 and 24 respectively for example by bonding or vulcanizing.

A ball type, anti-friction bearing 26 has outer and inner races 27 and 28 respectively. The outer race 27 is affixed to the inner housing 24 by snap rings 29. The inner race 28 is press fitted to an inner tubular splined shaft 31, which is in turn splined to a female spline of the rearward portion of the drive shaft 12.

The bearing assembly 11 is sealed between two lip-type oil seals 33 and 34 which are positioned at opposite ends of the race 24 outboard of the bearing 26. The rearward seal 33 faces and seals the cavity 15 around the drive shaft 12. The forward seal 34 seals the bearing assembly 11 from the engine compartment.

An oil tank (not shown) is positioned vertically above the outer supporting hub assembly 21 and supplies oil through a conduit 36 in which is positioned a one-way check valve (not shown) to a lubricant nipple 37 which penetrates the outer housing 23 and sealingly engages the conduit 36. The lubricant nipple 37 supplies oil to an oil cavity 38 via a lubricant supply port 39 that extends from the nipple 37 and through the hub intermediate and inner housings 25 and 24 respectively. The oil cavity 38 is formed between the bearing rearward spacer 29 and the rearward seal 33. With this configuration, oil may readily flow into the bearing 26 to provide lubrication but is also prevented from escaping out of the bearing assembly 11 by the seals 33 and 34. If any lubricant does escape, it is easily replenished by oil from the oil tank.

The invention as thus far described, is identical to that described in the U.S. Pat. No. 5,372,526 issued Dec. 13, 1994, and assigned to the assignee hereof, which patent is entitled "Drive Bearing Lubrication Device For Water Injection Propulsion Vessel." A problem can occur with this configuration where it is possible that the rearward seal 33 may be pushed forward by the pressure of the water in the cavity 15 into the oil cavity 38 and block the oil passage 39 which would impede or cut off the supply of oil to the bearing 26.

Figure 3:
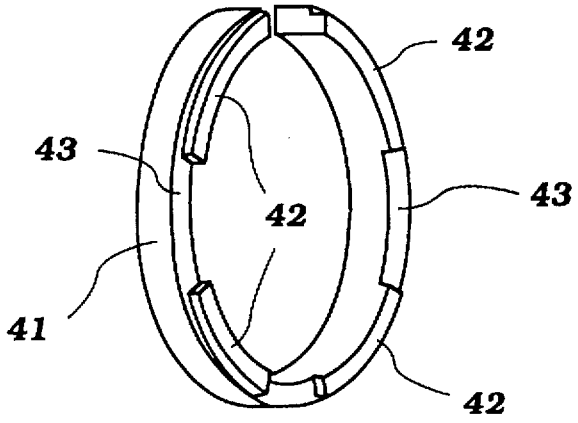
FIG. 3 is a perspective view of the spacer element.
Figure 4:
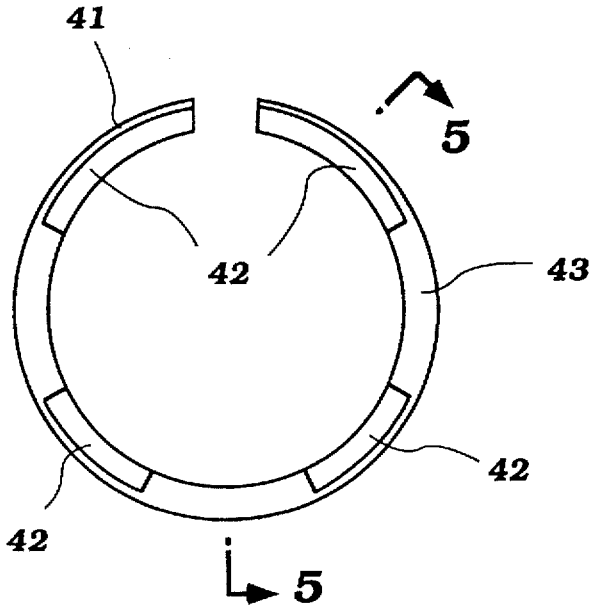
FIG. 4 is a rear plan view of the spacer element.
Figure 5:
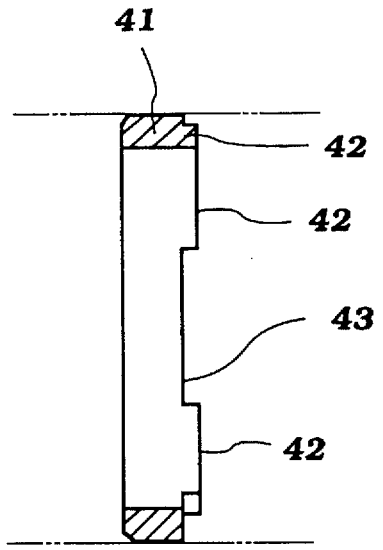
FIG. 5 is a cross-sectional view of the spacer element taken along line A—A of FIG. 4.

An embodiment of this invention eliminates this potential by disposing a spacer element in the oil cavity 38 which prevents forward movement by the seal 33. Referring to FIGS. 3, 4, and 5, a spacer element is indicated generally by the reference numeral 41 on which are intermittently disposed raised surfaces 42. With particular reference to FIG. 2, it is readily apparent that when spacer element 41 is disposed in the oil cavity 38, the seal 33 is prevented from moving forward while oil from the passage 39 is able to enter the oil cavity 38 through the openings 43 around the raised surfaces 42 of the spacer element 41.

The inner housing 24 is formed with a barbed recess 44 (FIG. 2) into which the elastic coating 45 of the seal 33 will extrude to further assist in holding the seal 33 in position and preclude blocking of the lubricant passage 39.

Figure 6:
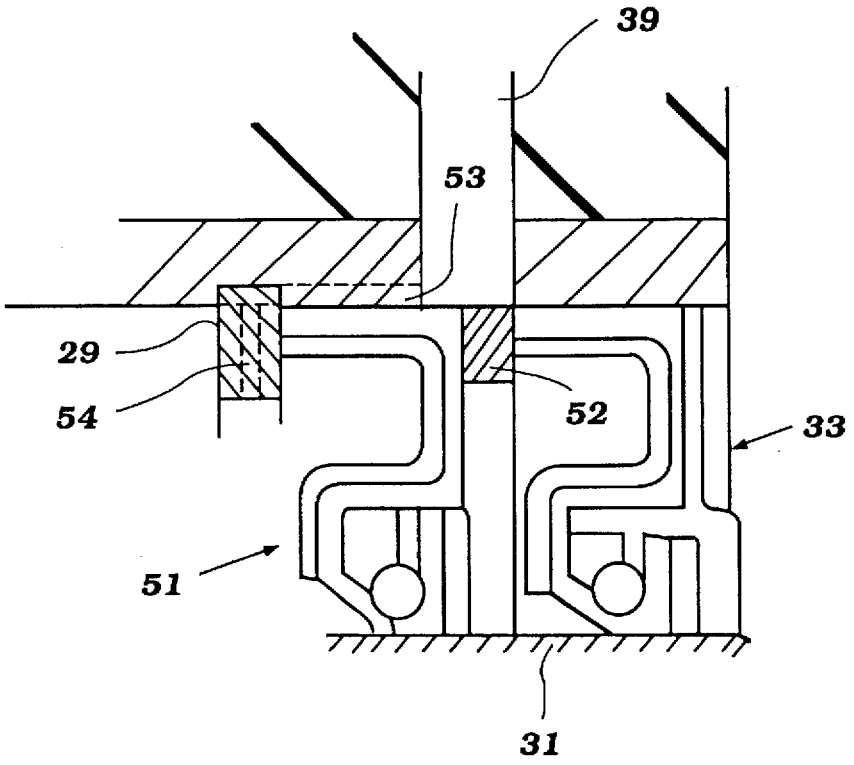
FIG. 6 is a cross sectional view in part similar to FIG. 2 and illustrates another embodiment of the invention.

A further embodiment of the invention is illustrated in FIG. 6 and provides further protection against intrusion of water from the cavity 15 into the bearing assembly 11. A second rearward oil seal 51 is disposed in the oil cavity 38 and held in position relative to the first rearward oil seal 33 by a further spacer 52. A lubricant passage 53 is drilled along the interior surface of the inner housing 24 above the seal 52 and extends from the bottom of the lubricant supply port 39 to a further lubricant inlet passage 54 which extends through the spacer 29 through which oil from the lubricant supply port 39 may pass and lubricate the bearing 26.

It should be readily apparent from the above that the bearing assemblies described not only ensure that an adequate supply of lubricating oil is maintained to the bearing but also that the bearing assembly is sufficiently protected against intrusion by elements outside of the assembly. Of course, the foregoing description is that of preferred embodiments of the invention, and various changes and modifications may be made without departing from the spirit and scope of the invention, as defined by the appended claims.

What is claimed is:

1. A marine propulsion system for transmitting drive between an engine positioned in an engine compartment of the watercraft and a propulsion device disposed beyond a bulkhead formed at one end of said engine compartment, a support hub affixed to said bulkhead on one side thereof, a shafting arrangement interconnecting said engine output shaft and said propulsion device and extending through said hub, an anti-friction bearing having an inner race supported on said shafting arrangement and an outer race fixed axially within said hub between the ends of said hub, a pair of seals disposed within said supporting hub at opposite ends thereof and on opposite sides of said anti-friction bearing, a spacer element interposed between said anti-friction bearing element and at least one of said seals for maintaining a fixed gap therebetween, and a lubricant supply port extending through said support hub and terminating in said space.

2. A marine propulsion system as set forth in claim 1, wherein the spacer element is provided with openings for communicating lubricant from the lubricant supply opening to the space through the spacer element.

3. A marine propulsion system as set forth in claim 1 further including a barbed recess formed in said support hub for receiving elastic material of said seal for maintaining said seal in position.

* * * * *